US006599153B2

(12) United States Patent
Nishide

(10) Patent No.: US 6,599,153 B2
(45) Date of Patent: Jul. 29, 2003

(54) CONNECTOR WITH INCORRECT FITTING PREVENTION MEANS

(75) Inventor: Satoru Nishide, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/919,906

(22) Filed: Aug. 2, 2001

(65) Prior Publication Data

US 2002/0039862 A1 Apr. 4, 2002

(30) Foreign Application Priority Data

Sep. 29, 2000 (JP) ..... 2000-299651

(51) Int. Cl.[7] ..... H01R 13/64
(52) U.S. Cl. ..... 439/681; 439/271; 439/587
(58) Field of Search ..... 439/680, 681, 439/271, 27, 275, 587, 588

(56) References Cited

U.S. PATENT DOCUMENTS 4,350,409 A * 9/1982 Kato et al. ..... 339/186
4,376,565 A * 3/1983 Bird et al. ..... 339/186
4,747,792 A * 5/1988 Strate ..... 439/681
5,254,019 A * 10/1993 Noschese ..... 439/681
5,312,268 A 5/1994 Sumida
5,314,356 A * 5/1994 Isohata et al. ..... 439/681
5,618,198 A * 4/1997 Sato et al. ..... 439/274
6,190,203 B1 * 2/2001 Murakami et al. ..... 439/587

FOREIGN PATENT DOCUMENTS

JP 60-152272 10/1985
JP 3-226978 10/1991

* cited by examiner

*Primary Examiner*—P. Austin Bradley
*Assistant Examiner*—Truc Nguyen
(74) *Attorney, Agent, or Firm*—Banner & Witcoff, Ltd.

(57) ABSTRACT

The invention reduces the mold costs of a connector provided with an incorrect fitting preventing means. Sub-connectors 20A and 20B, which are respectively fitted into fitting cavities 11A and 11B of a frame 10, are each provided with a connector housing 21, and a cover 45A and 45B respectively. Protrusions 49A and 49B, which function as incorrect fitting preventing members, are formed on the covers 45A and 45B respectively. The connector housings 21, which house terminal fittings 30, have a complex shape. In contrast, the covers 45A and 45B, each of which merely maintains a collective rubber stopper 40 in position, are simple in shape and consequently the mold cost thereof is low. The components provided with the protrusions 49A and 49B are molded as a plurality of types and yet have lower mold costs.

14 Claims, 5 Drawing Sheets

CONNECTOR WITH INCORRECT FITTING PREVENTION MEANS

TECHNICAL FIELD

The present invention relates to a connector provided with a means for preventing incorrect fitting.

BACKGROUND TO THE INVENTION

A partitioned electrical connector is formed from a male connector, this being provided with a plurality of fitting cavities in an anterior face thereof, and a plurality of female connectors which fit into the fitting cavities of the male connector. In the case where all the fitting cavities have the same shape, there is the danger that the female connectors might be fitted into the wrong fitting cavities.

One means to prevent this incorrect fitting has been to provide grooves or ribs on an inner circumference of each fitting cavity, the location of the grooves or ribs differing in each case, and to provide grooves or ribs on an outer circumference of each female connector, these corresponding respectively to the ribs or grooves of the fitting cavity with which it should be fitted.

In this conventional incorrect fitting preventing means, the ribs or grooves of the female connectors are provided on a plastic connector housing of the female connectors. The interior of this connector housing has a complex form, being provided with a plurality of cavities, plastic lances for retaining terminal fittings, etc.

In general, the more complex the shape of moulded components, and consequently the more complex the shape of a mould, the greater the production cost of that mould. The mould for the connector housing is already complex in shape, and providing ribs or grooves renders this shape even more complex, this increasing the cost of the mould, which is undesirable. Since there are a plurality of types of female connectors, costs increase greatly.

The increase in mould costs which arise out of providing this type of incorrect fitting preventing means is not limited to partitioned connectors. It is equally applicable to connectors wherein a single male connector is fitted to a single female connector, for example for ensuring correct orientation. The present invention has taken the above problem into consideration, and aims to reduce the mould costs of a connector provided with an incorrect-fitting preventing means.

SUMMARY OF THE INVENTION

According to the invention there is provided an electrical connector comprising a frame defining a symmetrical cavity therein, and an insert insertable into said cavity in a close fitting manner, the inner circumference of said cavity and the outer circumference of said insert having mutually engageable discontinuities adapted to ensure a predetermined orientation of said insert in said cavity wherein said insert comprises a housing adapted to receive electrical terminal fittings, and an orientation member for attachment to said housing, the discontinuity of said insert being provided on said orientation member.

Such an arrangement allows a common housing to be utilized in a plurality of similar cavities, each housing having a unique orientation given by the orientation member. Since the housing is generally a rather complex moulding, costs can be reduced.

Preferably the orientation member is at the rear of the housing so that the corresponding discontinuity can be immediately adjacent the mouth of the cavity. In this way a more interior part of the cavity can present a smooth continuous circumference adapted to be contracted by a peripheral seal of the housing.

In a preferred embodiment, the housing and orientation member sandwich a seal therebetween. In a case where wires of electrical terminals pass through the orientation member, such a seal is provided with apertures for the wires, and the seal may resiliently grip the wires in order to provide a moisture seal at these respective locations.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 8.

A frame 10 is moulded from plastic. The interior thereof comprises an upper and lower pair of fitting cavities 11A and 11B that open onto a posterior end face thereof, and a plurality of cavities 12 that are located between the fitting cavities 11A and 11B and also open onto the posterior end face of the frame 10. Each of the fitting cavities 11A and 11B has a horizontally extending oval shape. Inner circumference faces of both the upper and lower fitting cavities 11A and 11B have the same dimensions along their upper faces and lower faces (i.e., in a side to side), and in the distance between the upper faces and lower faces (i.e., in an up-down direction). The inner circumference faces of the fitting cavities 11A and 11B are also identical in the curvature of their semi-circular arcs formed at left and right ends, and in the dimensions of their radii. When viewed from the posterior (this corresponds to the direction from which sub-connectors 20A and 20B are fitted to the fitting cavities 11A and 11B), the upper fitting cavity 11A and the lower fitting cavity 11B are identical in shape and dimension.

Figure 2:
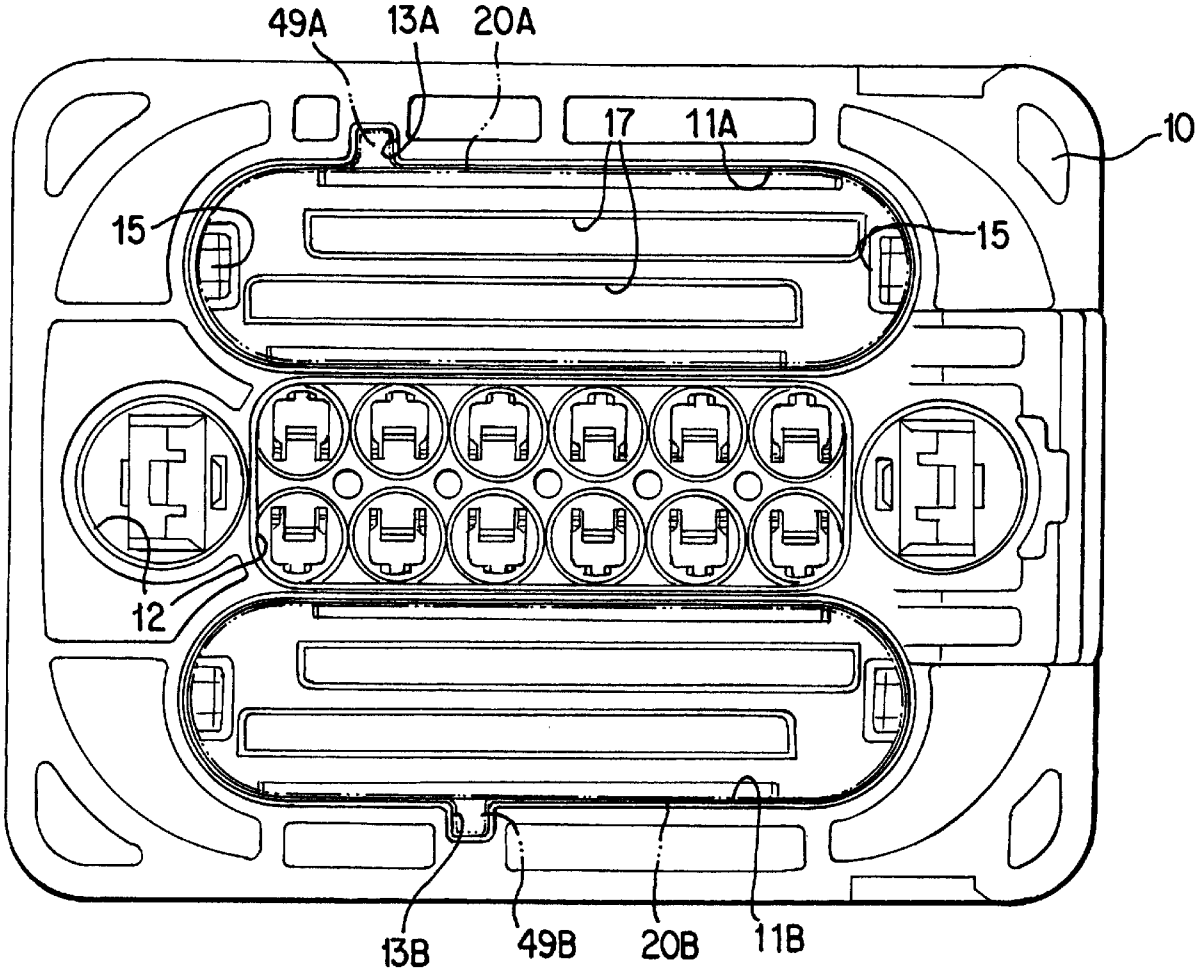
FIG. 2 is a front view showing a frame.
Figure 3:
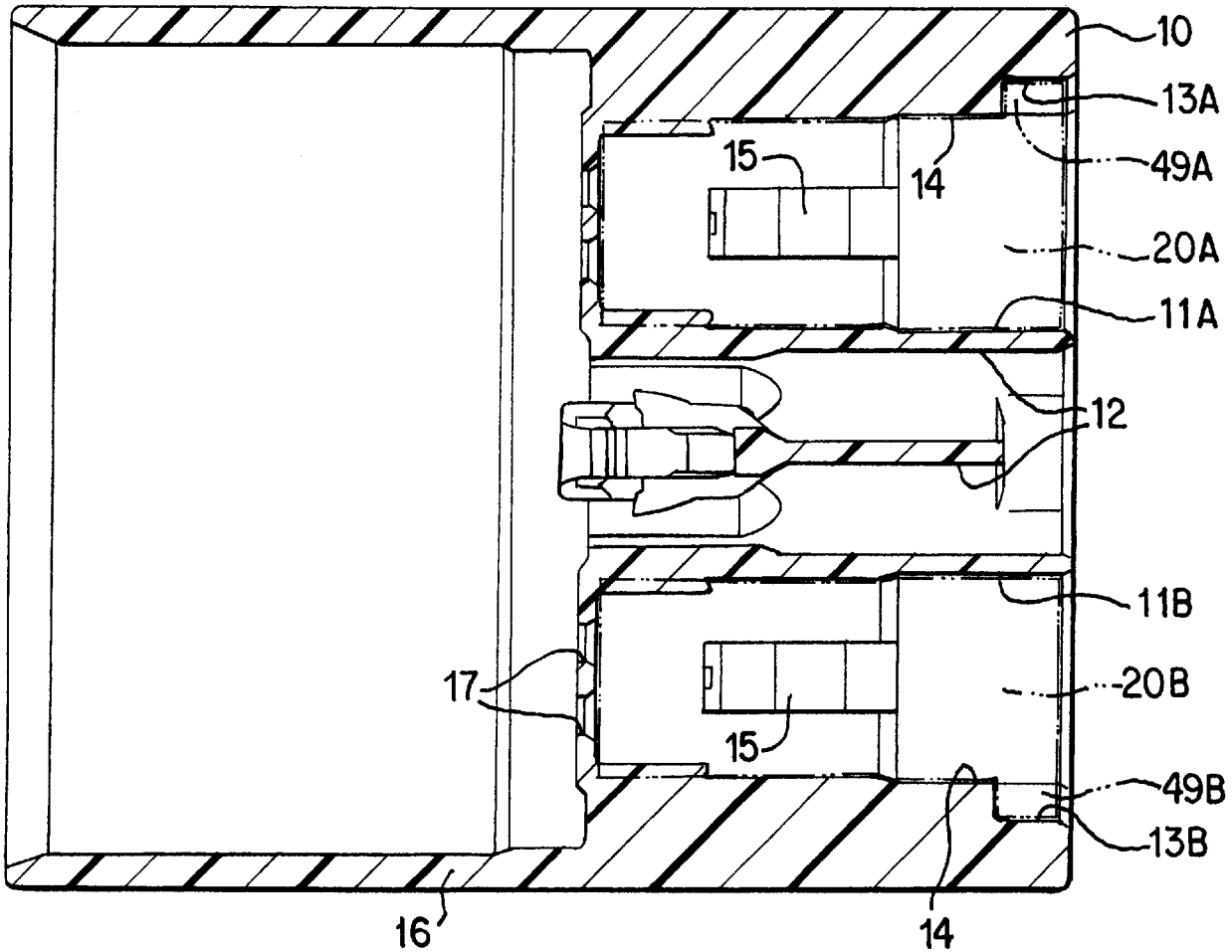
FIG. 3 is a cross-sectional view of the frame.
Figure 4:
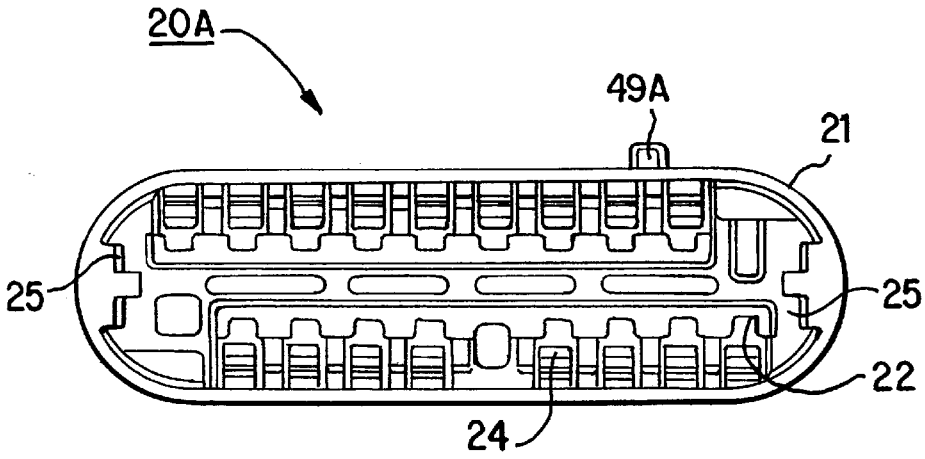
FIG. 4 is a front view of a sub-connector.
Figure 5:
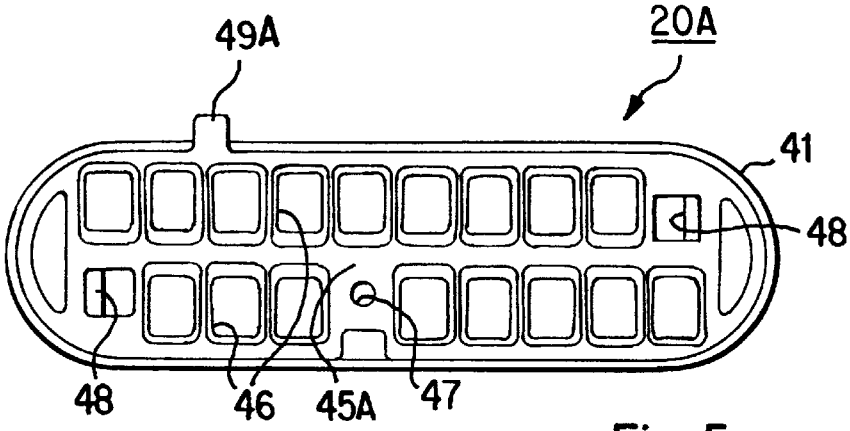
FIG. 5 is a rear face view of the sub-connector.
Figure 6:
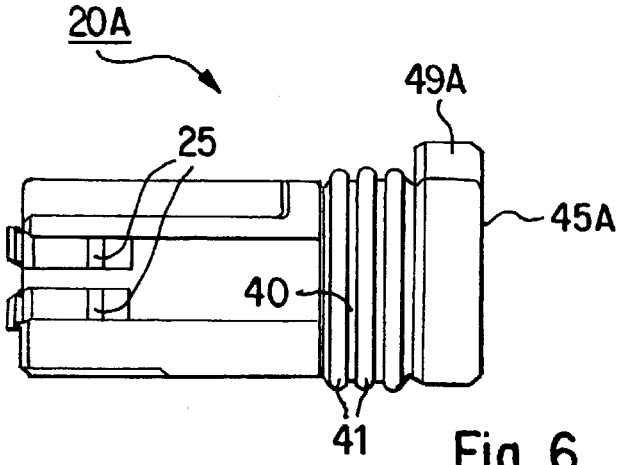
FIG. 6 is a side face view of the sub-connector.
Figure 7:
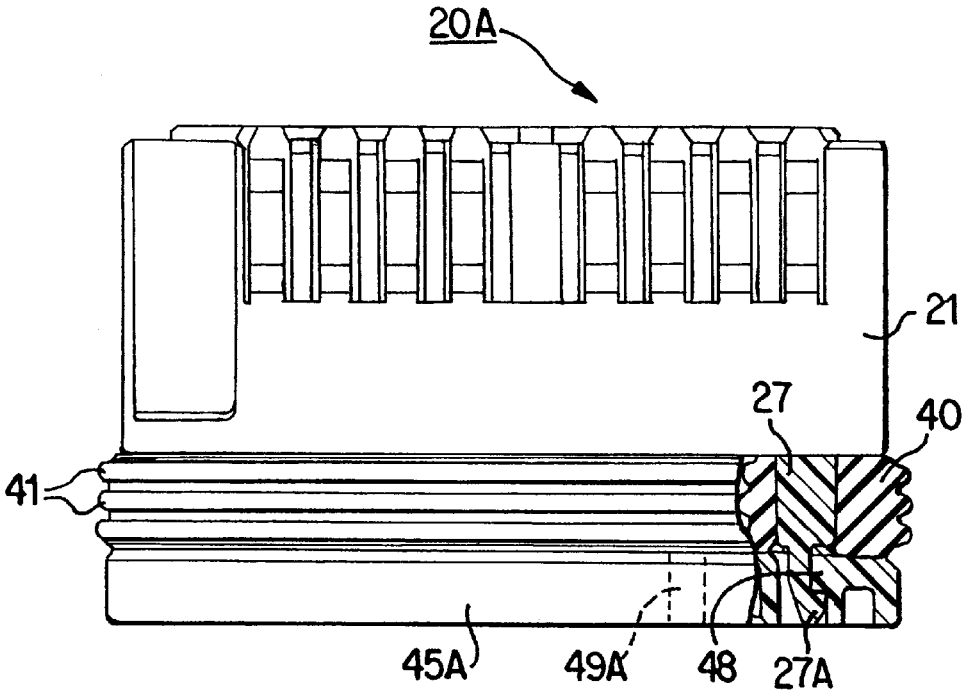
FIG. 7 is a partially cut-away base face view of the sub-connector.
Figure 8:
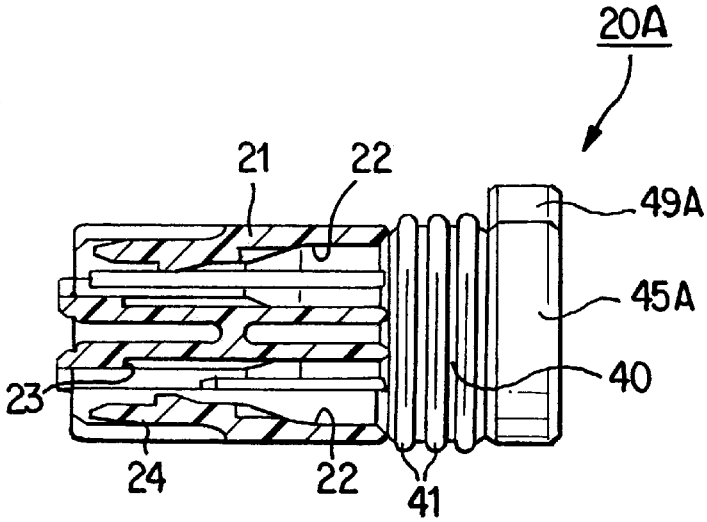
FIG. 8 is a partial cross-sectional view of the sub-connector.

Grooves 13A and 13B are formed on the inner circumferences of the fitting cavities 11A and 11B, these grooves 13A and 13B serving as a means to prevent either of two types of sub-connectors 20A and 20B (these are described later) from being fitted incorrectly. When viewed from the fitting direction of the sub-connectors 20A and 20B, the grooves 13A and 13B have an approximately square shape and each is located at a mutually differing location on the upper fitting cavity 11A and the lower fitting cavity 11B respectively. That is, as shown in FIG. 2, the groove 13A is located on the upper face of the upper fitting cavity 11A at a location towards the left side, and the groove 13B is located on the lower face of the lower fitting cavity 11B at a location slightly towards the left relative to the centre (in the left-right direction) thereof. In this manner, the grooves 13A and 13B are provided at mutually differing locations relative to the centre, in the left-right direction, of the fitting cavities 11A and 11B. Consequently, the grooves 13A and 13B of the fitting cavities 11A and 11B have differing locations even if the frame 10 is viewed after it has been turned upside down.

The grooves 13A and 13B extend for only a short distance in the anterior-posterior direction, extending from opening ends at the posterior face side of the fitting cavities 11A and 11B. Inwards from the grooves 13A and 13B, the inner circumference faces of the fitting cavities 11A and 11B form sealing faces 14 that extend seamlessly along their entire circumferences.

Furthermore, a pair of left and right retaining protrusions 15, for retaining the sub-connectors 20A and 20B, are formed on the inner circumference of each fitting cavity 11A and 11B at locations inwards relative to the sealing faces 14. Long tab through holes 17 are formed in innermost end faces of the fitting cavities 11A and 11B. Tabs 32 of terminal fittings 30, once fitted into the sub-connectors 20A and 20B, are passed through these through holes 17 so as to protrude into a hood 16.

Figure 1:
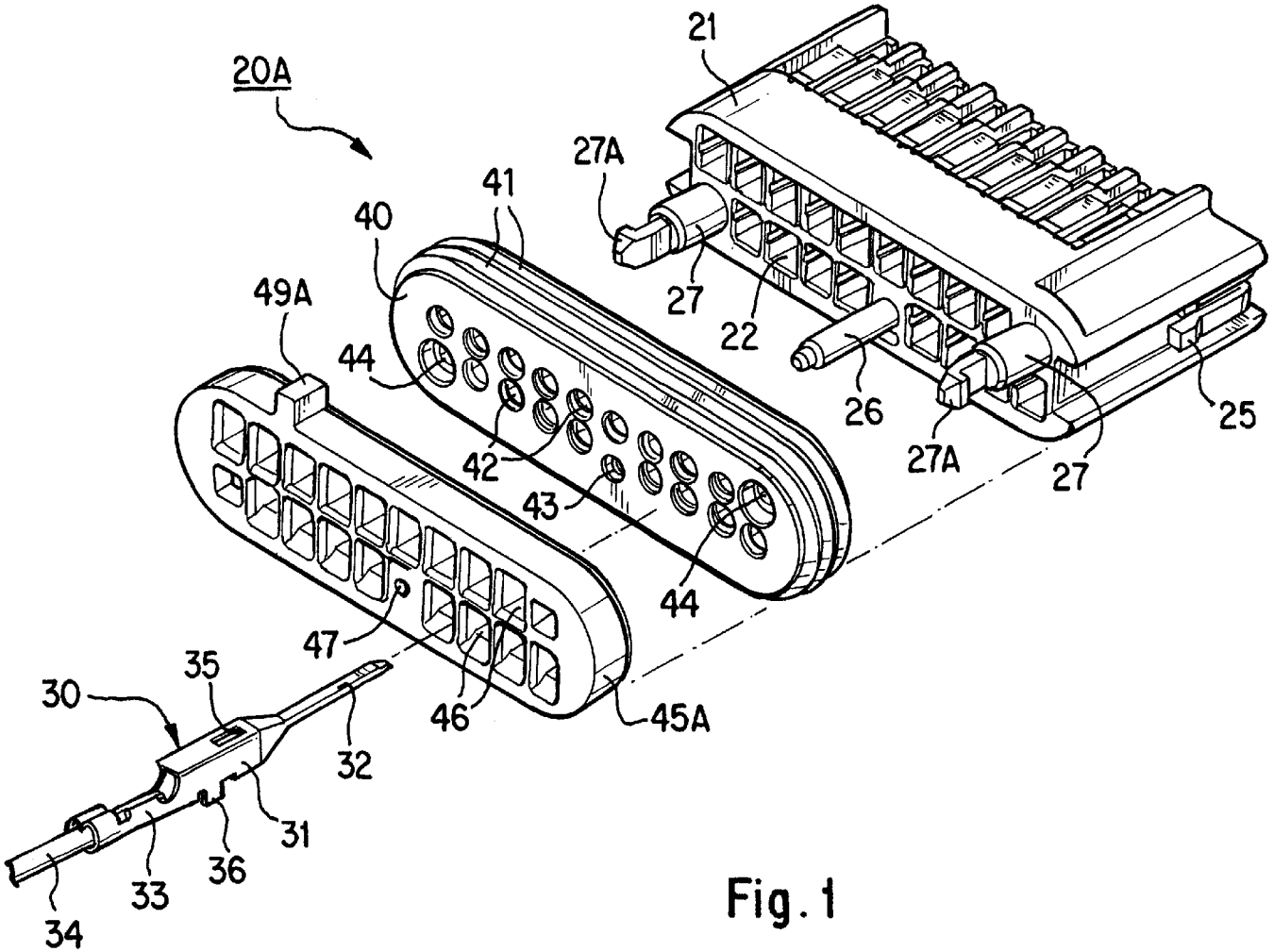
FIG. 1 is a disassembled diagonal view of a sub-connector of an embodiment of the invention.

The fitting cavities 11A and 11B are formed such that each of the two types of sub-connectors 20A and 20B will fit only into the correct fitting cavity 11A or 11B. FIG. 1 shows the sub-connector 20A that fits into the upper fitting cavity 11A. The figure showing the sub-connector 20B is omitted.

The two sub-connectors 20A and 20B have identical components except for the stopper covers 45A and 45B. First, the identical components and the identical portions of the stopper covers 45A and 45B will be described. Each sub-connector 20A and 20B is composed of: a plastic moulded connector housing 21, a plurality of terminal fittings 30 housed within the connector housing 21, electric wires 34 that are joined to the terminal fittings 30, a collective rubber stopper 40 that is attached tightly to a posterior end face of the connector housing 21, and the cover 45A or 45B. These covers 45A and 45B are moulded from plastic and, by means of being attached to the connector housing 21, maintain the collective rubber stopper 40 in a state whereby it is attached to this connector housing 21.

Each connector housing 21 is oval in shape, and has a shape and dimensions whereby it can be fitted into the fitting cavities 11A or 11B without rattling therein. A plurality of cavities 22 are formed in each connector housing 21, these being open at anterior and posterior end faces thereof. Stoppers 23 and plastic lances 24 are formed in these cavities 22. A pair of bendable retaining members 25 are formed at left and right side faces of each connector housing 21. A movement preventing pin 26, for preventing each collective rubber stopper 40 from moving in an up-down direction, protrudes from an approximately central location of the posterior end face of each connector housing 21. A pair of left and right retaining pins 27, for maintaining the rubber stopper covers 45A or 45B in an attached state, protrude from the posterior end face of each connector housing 21.

Each terminal fitting 30 is made from metal, and has an angular tubular member 31, a long and narrow tab 32 protruding to the anterior from the angular tubular member 31, and an electric wire crimping member 33 protruding to the posterior from the angular tubular member 31. An electric wire 34 is joined, by being crimped thereto, to the electric wire crimping member 33. A retaining hole 35 is formed in the angular tubular member 31. When the terminal fitting 30 has been correctly fitted into the cavity 22, the plastic lance 24 therein engages with this retaining hole 35, thereby maintaining the terminal fitting 30 in an unremovable state. Furthermore, stabilisers 36 protrude from the angular tubular member 31. These stabilisers 36 stabilise the position of the terminal fitting 30 while it is being inserted into the cavity 22, and make contact with the stoppers 23 of the cavity 22 when the terminal fitting 30 has been inserted to a correct position therein, thereby preventing the terminal fitting 30 from moving further to the anterior.

Each collective rubber stopper 40 has a thick oval plate shape, and the entirety of an anterior face thereof fits tightly with the posterior end face of each connector housing 21. A plurality of lips 41 are formed on an outer circumference of the collective rubber stopper 40. These lips 41 protrude outwards beyond an outer face of the connector housing 21 and fit tightly with the sealing faces 14 of the fitting cavities 11A or 11B, bending resiliently thereagainst so as to maintain a waterproof state. A plurality of electric wire through holes 42 pass through the collective rubber stopper 40 from the anterior to the posterior face thereof at locations which correspond to the cavities 22. The electric wires 34 extend from the posterior end face of the connector housing 21 and pass, in a waterproof state, to the posterior through these electric wire through holes 42. Pin through holes 43 and 44, through which the movement preventing pin 26 and the retaining pins 27 pass in a waterproof state, are formed in the collective rubber stopper 40.

The covers 45A and 45B are thick oval plates, the dimensions and the shape of the outer circumference thereof being identical with each connector housing 21. A plurality of fitting holes 46, which have a size sufficient for the terminal fittings 30 to pass therethrough, are formed in the covers 45A and 45B at locations corresponding to the electric wire through holes 42. A receiving hole 47, into which a tip of the movement preventing pin 26 can be fitted, is formed in each of the covers 45A and 45B. Receiving members 48, which retain claws 27A of tips of the retaining pins 27, are formed in each of the covers 45A and 45B.

When the sub-connectors 20A and 20B are to be attached, the collective rubber stopper 40 is first fitted tightly to the posterior end face of each connector housing 21, and the movement preventing pin 26 and the retaining pins 27 are passed through the pin through holes 43 and 44. Next, the covers 45A and 45B are fitted tightly to the posterior end face of the collective rubber stopper 40, the tip of the movement preventing pin 26 fits into the receiving hole 47, and the claws 27A of the retaining pins 27 engage with the receiving members 48. In this state, each collective rubber stopper 40 is pressed resiliently between each connector housing 21 and the covers 45A and 45B. Consequently, the space between each connector housing 21 and each collective rubber stopper 40, and the space between each collective rubber stopper 40 and the covers 45A and 45B, is maintained in a waterproof state.

Next, the terminal fittings 30 are inserted from the posterior into each connector housing 21. At this juncture, the terminal fittings 30 are passed first through the fitting holes 46, then through the electric wire through holes 42, then are inserted into the cavities 22. After the terminal fittings 30 have been inserted into the cavities 22, the plastic lances 24 engage with the retaining holes 35, and the stabilisers 36 make contact with the stoppers 23, thereby maintaining the terminal fittings 30 in a state whereby they do not move in a direction of insertion or of removal.

Approximately square-shaped protrusions 49A and 49B are formed in a unified manner, by means of moulding, on the outer circumference of the covers 45A and 45B respectively. These protrusions 49A and 49B serve as a means to prevent the two types of sub-connectors 20A and 20B from being fitted incorrectly into the fitting cavities 11A or 11B. The protrusions 49A and 49B are located at mutually differing locations on the sub-connectors 20A or 20B respectively, the differing locations thereof serving as a means by which the two types of sub-connectors 20A and 20B can be distinguished. That is, the cover 45A, which is a component of the sub-connector 20A that is to be fitted into the upper fitting cavity 11A, is provided with the protrusion 49A. This protrusion 49A, which corresponds to the groove 13A of the upper fitting cavity 11A, is located (when viewed from the posterior) near the left side of an upper face of the cover 45A (see FIG. 5). The cover 45B, which is a component of the sub-connector 20B that is to be fitted into the lower fitting cavity 11B, is provided with the protrusion 49B. This protrusion 49B, which corresponds to the groove 13B of the lower fitting cavity 11B, is located (when viewed from the posterior) slightly to the left of a central position, relative to the left-right direction thereof, of a lower face of the cover 45B. That is, the protrusions 49A and 49B are located at different distances from the centre, relative to the left-right direction thereof, of the two types of cover 45A and 45B, this allowing the two sub-connectors 20A and 20B to be distinguished. Consequently, the protrusions 49A and 49B of the two sub-connectors 20A and 20B have differing locations even if the covers 45A and 45B are viewed after having been turned upside down. Furthermore, the protrusions 49A and 49B have dimensions whereby they protrude further to the exterior than outer circumferences of the lips 41 of the collective rubber stopper 40.

In the case where the two sub-connectors 20A and 20B are fitted correctly into the fitting cavities 11A and 11B respectively, the connector housings 21 are first inserted into the fitting cavities 11A and 11B, then the collective rubber stoppers 40 are attached, and the protrusions 49A and 49B fit, without catching, into the grooves 13A and 13B. When the sub-connectors 20A and 20B have been inserted to a correct position, the bendable retaining members 25 engage with the retaining protrusions 15, thereby maintaining the sub-connectors 20A and 20B in an unremovable state, and the lips 41 of the collective rubber stoppers 40 fit tightly, in a waterproof manner, with the sealing faces 14 of the fitting cavities 11A and 11B, thereby waterproofing the interior of these fitting cavities 11A and 11B.

In the case where one attempts to fit the two sub-connectors 20A and 20B incorrectly into the fitting cavities 11B and 11A, the protrusions 49B and 49A strike against opening edges of the fitting cavities 11A and 11B respectively, thereby preventing the fitting operation from continuing. It can thus be determined that the sub-connectors 20A and 20B were being fitted into the wrong fitting cavities 11B and 11A respectively.

In this manner, although the connector housings 21 have a comparatively complex shape due to their housing the terminal fittings 30, the covers 45A and 45B, which function as attachment members attached to the connector housings 21, made comparatively simple in shape. The cost of producing the moulds for the covers 45A and 45B is lower than that for the moulds for the connector housings 21. Further, in the present embodiment, the components provided with the protrusions 49A and 49B (which function as incorrect-fitting preventing members) are moulded as a plurality of types. However, these protrusions 49A and 49B are not formed on the connector housing 21, which has a complex shape, but on the covers 45A and 45B, which have a simple shape. Consequently, the cost of the moulds is reduced.

The two sub-connectors 20A and 20B have components in common. Consequently, only one kind of mould is needed to mould each connector housing 21. This further reduces costs.

Moreover, the protrusions 49A and 49B of the sub-connectors 20A and 20B are located to the posterior (relative to the direction in which the sub-connectors 20A and 20B are fitted into the fitting cavities 11A and 11B) of the collective rubber stoppers 40. Consequently, the grooves 13A and 13B are located within the fitting cavities 11A and 11B to the posterior of the collective rubber stoppers 40 and of the sealing faces 14 (that is, the grooves 13A and 13B are located at the opening face sides of the fitting cavities 11A and 11B). As a result, the moulding space for the grooves 13A and 13B does not conflict with the sealing faces 14, and therefore these sealing faces 14 are formed smoothly without protrusions or concave portions.

The protrusions 49A and 49B of the covers 45A and 45B do not affect the sealing function of the collective rubber stoppers 40. Consequently, these protrusions 49A and 49B can protrude for a considerable distance from the outer circumference of the collective rubber stoppers 40. Enlarging the protrusions 49A and 49B in this manner ensures that they strike to a greater degree against the opening edges of the fitting cavities 11B and 11A when incorrect fitting takes place, thus increasing the reliability of the incorrect fitting preventing means. Furthermore, since both the protrusions 49A and 49B and the grooves 13A and 13B are larger, one can easily observe the location of these protrusions 49A and 49B and grooves 13A and 13B, thereby preventing incorrect fitting from taking place.

The present invention is not limited to the embodiments described above with the aid of figures. For example, the possibilities described below also lie within the technical range of the present invention. In addition, the present invention may be embodied in various other ways without deviating from the scope thereof.

(1) The above embodiment describes a case suitable for a partitioned connector wherein a plurality of second members are fitted into a single first member. However, the present invention is equally suitable for a connector wherein a single first member and a single second member are fitted together.

(2) In the embodiment described above, the incorrect fitting preventing members of the second members are formed on the covers. However, according to the present invention, the incorrect fitting preventing members need not be formed only on the covers. They may equally well be formed on a retainer for retaining the terminal fittings (this may be a front retainer attached to the connector housings of the second members from the anterior, a side retainer which is attached from a side, or a rear retainer attached from the posterior), or may be formed on an electric wire cover which maintains the electric wires extending from the connector housings of the second members in a prescribed bent shape, etc.

(3) In the embodiment described above, the incorrect fitting preventing members of the first member are formed in a concave shape, and the incorrect fitting preventing members of the second members are formed in a protruding shape. However, according to the present invention, the incorrect fitting preventing members of the first member may be formed a protruding shape and the incorrect fitting preventing members of the second members may be formed in a concave shape, or both the first and the second members may each be provided with incorrect fitting preventing members formed in both concave and protruding shapes.

What is claimed is:

1. An electrical connector comprising a frame defining a cavity therein, said cavity having an anterior end and a posterior end, and an insert having an anterior end and a posterior end, said anterior end of said insert insertable into a posterior end of said cavity in a close fitting manner, an inner circumference of said cavity and an outer circumference of said insert having mutually engageable discontinuities adapted to prevent incorrect fitting of said insert in said cavity when said anterior end of said insert is inserted into said posterior end of said cavity, wherein said insert comprises a housing adapted to receive electrical terminal fittings, and an orientation member separable from and attachable to said housing, the discontinuity of said insert being provided on said orientation member, said housing including a plurality of openings adapted to receive electrical terminals, and said orientation member including corresponding apertures for wires of said terminals.

2. A connector according to claim 1 wherein said discontinuities comprise a projection and a recess.

3. A connector according to claim 2 wherein said projection is provided on said orientation member.

4. A connector according to claim 1 wherein said orientation member is at the rear of said insert with respect to a direction of insertion into said cavity.

5. A connector according to claim 1 and further including releasable latch means to retain said orientation member to said housing.

6. A connector according to claim 1 wherein said insert is fully insertable into said cavity.

7. A connector according to claim 3 and further including releasable latch means to retain said orientation member to said housing.

8. A connector according to claim 5 wherein said insert is fully insertable into said cavity.

9. A connector according to claim 3 and further including a resilient seal between said housing and said orientation member, said seal engaging the inner circumference of said cavity.

10. A connector according to claim 9 wherein said seal is planar and includes apertures for resiliently sealing wires of said terminals.

11. A connector according to claim 10 and further including a location member extending between said housing and said orientation member, and for positioning said seal.

12. An electrical connector comprising a frame defining a cavity therein, said cavity having an anterior end and a posterior end, and an insert having an anterior end and a posterior end, said anterior end of said insert insertable into a posterior end of said cavity in a close fitting manner, an inner circumference of said cavity and an outer circumference of said insert having mutually engageable discontinuities adapted to prevent incorrect fitting of said insert in said cavity when said anterior end of said insert is inserted into said posterior end of said cavity, wherein said insert comprises a housing adapted to receive electrical terminal fittings, and an orientation member separable from and attachable to said housing, the discontinuity of said insert being provided on said orientation member, and a resilient seal between said housing and said orientation member, said seal engaging the inner circumference of said cavity.

13. A connector according to claim 12 wherein said seal is planar and includes apertures for resiliently sealing wires of said terminals.

14. A connector according to claim 13 and further including a locating member extending between said housing and said orientation member, and for positioning said seal.

* * * * *